US006638032B1

(12) United States Patent
Vanden Brande et al.

(10) Patent No.: US 6,638,032 B1
(45) Date of Patent: Oct. 28, 2003

(54) ACOUSTIC VACUUM PUMP

(76) Inventors: Pierre Vanden Brande, 27, Vlierbeekberg, B-3090 Overijse (BE); Alain Weymeersch, 33, boite 10, rue Charles Jaumotte, B-1300 Wavre (BE)

( * ) Notice: Subject to any disclaimer, the term of this patent is extended or adjusted under 35 U.S.C. 154(b) by 0 days.

(21) Appl. No.: 09/856,860

(22) PCT Filed: Nov. 25, 1999

(86) PCT No.: PCT/BE99/00153

§ 371 (c)(1),
(2), (4) Date: Oct. 29, 2001

(87) PCT Pub. No.: WO00/32940

PCT Pub. Date: Jun. 8, 2000

(30) Foreign Application Priority Data

Nov. 27, 1998 (EP) ..... 98203970

(51) Int. Cl.[7] ..... F04B 17/00; F04B 19/24
(52) U.S. Cl. ..... 417/322; 417/52; 417/410.1
(58) Field of Search ..... 417/52, 322, 410.1, 417/244

(56) References Cited

U.S. PATENT DOCUMENTS 3,743,446 A 7/1973 Mandroian
4,171,852 A * 10/1979 Haentjens ..... 406/85
4,296,417 A * 10/1981 Markham et al. ..... 347/75
4,360,087 A 11/1982 Curwen
4,808,084 A * 2/1989 Tsubouchi et al. ..... 417/322
5,020,977 A * 6/1991 Lucas ..... 417/322
5,231,337 A * 7/1993 van Namen ..... 318/128
5,295,791 A 3/1994 Meise
5,357,757 A 10/1994 Lucas
5,515,684 A * 5/1996 Lucas et al. ..... 62/6
5,525,041 A * 6/1996 Deak ..... 417/63

FOREIGN PATENT DOCUMENTS

DE 195 39 020 A1 4/1997
JP 08-219100 * 8/1996 ..... F04F/7/00

* cited by examiner

*Primary Examiner*—Charles G. Freay
*Assistant Examiner*—Timothy P. Solak
(74) *Attorney, Agent, or Firm*—Browdy & Neimark, P.L.L.C.

(57) ABSTRACT

Vacuum pump with a chamber (1) having, on one side, an intake (2) for pumping gas and, on the opposite side, an outlet (3) for the gas, displacement elements (4) being provided to drive the gas from the intake (2) towards the outlet (3), the displacement elements (4) including at least a vibrating element (4) for generating sound waves moving in the chamber (1), elements for closing (6) the outlet (3) being provided synchronously co-operating with the displacement elements (4) so as to clear the outlet opening (3) when the gas pressure in the proximity of the outlet (3) is higher than that in the proximity of the intake (2).

17 Claims, 4 Drawing Sheets

ACOUSTIC VACUUM PUMP

CROSS REFERENCE TO RELATED APPLICATION

The present application is the national stage under 35 U.S.C. 371 of international application PCT/BE99/00153, filed Nov. 25, 1999 which designated the United States, and which international application was published under PCT Article 21(2) in the English language.

BACKGROUND OF INVENTION

A The present invention concerns a vacuum pump as defined in the preamble of claim 1.

In particular, the invention concerns a new type of vacuum pump representing major advantages in relation to the existing pumps which are at present available on the market and which function in a pressure range comprised between $10^{-2}$ mbar and 10 mbar, according to a principle which is completely different from the one upon which the operation of the existing pumps for said pressure range is based.

The vacuum pumps which are at present available on the market and which are designed to operate in said pressure range function by means of a volumetric drive of the gas, irrespective of what mechanical device is used. It may be for example a cam pump, also known as "Root" pump, whose outlet is connected to the intake of a primary pump, generally a vane pump or a rotary piston pump, if one wishes to maintain a pressure in the order of magnitude of $10^{-2}$ mbar to 10 mbar in a vacuum chamber or on the outlet of a molecular pump.

A "Root" pump is an equipment with a positive displacement which makes it possible to drive the gas at a low pressure as of the intake towards the outlet of the pump, where the pressure of the gas is higher, by means of two cams with parallel shafts rotating in a synchronised manner in the opposite sense according to a well-known principle. The tightness of such a pump is guaranteed by means of a relatively small clearance, in the order of magnitude of 0.05 mm to 0.25 mm, between the lobes of the cams and the inner wall of the pump.

Such a pump has several disadvantages, namely the following ones:

- the cams and the inner wall have to be tooled very precisely, which is consequently expensive, in order to allow for the small clearances required for its tightness and a perfect adjustment of the bearings and the camshafts;
- the ratio between the consumed energy and the energy which is actually required to drive the gas is relatively high, as this known pump makes it necessary to drive metal parts with a relatively high inertia and loses significant amounts of energy due to the friction at the bearings and the joints;
- when the cams heat up excessively, the pump has to be stopped in order to prevent it from being damaged due to the dilatation of the cams. In order to avoid this problem, the difference in pressure between the intake and the outlet of the pump is usually restricted to 10 mbar. In practice, in order to avoid this problem, a by-pass is provided for or the pump is set in free rotation as long as the pressure is equal or superior to 10 mbar;
- as each lob alternatively passes from a high-pressure zone at the outlet of the pump to a low-pressure zone at the intake of the latter, the gas is necessarily driven from the high-pressure side to the low-pressure side. The gas is adsorbed on the surface of the lobs on the high-pressure side, and a desorption of the gas takes place on the surface of the lobs when they reach the low-pressure zone of the pump, which necessarily restricts the capacity of this type of pump.

Document U.S. Pat. No. 5,295,791 concerns pumps which make it possible to compress or move a liquid according to a principle which is identical to that of the compressors described in the preamble of claim 1.

However, these pumps cannot operate at pressures which are lower than the atmospheric pressure.

BRIEF SUMMARY OF THE INVENTION

One of the main aims of the present invention is to provide a vacuum pump which does not have the disadvantages of the known volumetric pumps or of the pumps described and represented in document U.S. Pat. No. 5,295,791.

Thus, the pump according to the invention is characterised in that means are provided to subject the vibrating element to a vibration having an amplitude which is at least two times and preferably a hundred times higher than the average free path between the elastic collisions of the gas particles in the chamber, whereby this average free path corresponds to the local pressure measured near said vibrating element, thus making it possible to generate, with a pressure in the chamber comprised between $10^{-2}$ and 1000 mbar, and in particular between 0.01 and 10 mbar, sound waves forming successive compression and underpressure zones in said gas between the intake opening and the outlet opening.

The same applies to the characteristic dimensions of the path through the chamber of the intake up to the outlet of the latter, such as the hydraulic diameter at each passage, which also have to be two times and preferably a hundred times the average free path of the gas molecules flowing through said chamber, such for gas pressures comprised between $10^{-2}$ and 1000 mbar, in particular between 0.01 mbar and 10 mbar.

Advantageously, the above-mentioned chamber has a cross section which decreases in relation to the direction of movement of the gas as of the intake opening towards the outlet opening.

According to a particularly advantageous embodiment, the above-mentioned chamber has the shape of a pavilion whose section decreases as of the intake opening of the gas up to the outlet opening of the gas.

BRIEF DESCRIPTION OF THE DRAWINGS

Other details and particularities of the invention will become clear from the following description in which are represented three particular embodiments of the invention, as an example only without being limitative in any way, with reference to the accompanying drawings, in which.

In the different figures, the same reference figures refer to analogous or identical parts.

DETAILED DESCRIPTION OF THE INVENTION

The invention concerns a new type of vacuum pump, mainly designed for pumping a gas in a pressure zone situated between $10^{-2}$ mbar and 1000 mbar and preferably between $10^{-2}$ mbar and 10 mbar. It comprises a chamber having, on one of its sides, an intake opening for the gas to be pumped, and on the opposite side, an outlet opening for said gas, as well as means to make the gas flow from the intake opening to the outlet opening.

The above-mentioned displacement means comprise at least one vibrating element which makes it possible to generate sound waves in the gas to be pumped forming successive compression and underpressure zones in said gas, which flows naturally in said chamber.

This pump differs from the known vacuum pumps in that means, known as such and which are not represented in the accompanying figures, such as electromagnets, are provided to subject the vibrating element to a vibration having an amplitude which is at least two times and preferably at least a hundred times higher than the average free path between two elastic collisions of gas particles in the chamber.

The free path is a function of the local pressure, the nature of the gas, in particular the molecular or atomic diameter of the gas particles, and the temperature.

This average free path is the average distance covered by the molecules or atoms of a specific gas in between two elastic collisions of the latter, and it is in proportion to the T/P ratio, whereby T is the temperature in degrees Kelvin and P is the local pressure.

In practice, the pressure and the temperature of the gas are measured and, on the basis of a graph for this type of gas, the free path in this gas is automatically determined for the measured pressure and temperature. (see *"Handbook of Physical Vapor Deposition "PVD" Processing"* by Donald M. Mattox, Noyes Publications ISBN 0-8155-1422-0, pages 108 and 109).

Moreover, a closing element is preferably provided on the outlet opening which synchronously co-operates with the vibrating element, such that said outlet opening is cleared when the pressure of the gas near this opening is higher than the average pressure, called the base pressure $p_o$, prevailing at the intake opening.

Such an element on the outlet opening must not necessarily be provided, but it allows to obtain a better yield.

Advantageously, in order to obtain sufficient conductance on the intake of the chamber, the intake opening is as large as possible and preferably has a section which is equal to the largest section of the chamber.

For the same reason, the intake opening is not provided with a closing element. All these precautions are meant to ensure a liquid flow to the gas as of the intake of the chamber to the outlet of the latter, as opposed to a molecular flow, i.e. a flow whereby the gas follows the aerological laws.

The pump according to the invention may have one or several identical or non-identical stages.

Figure 1:
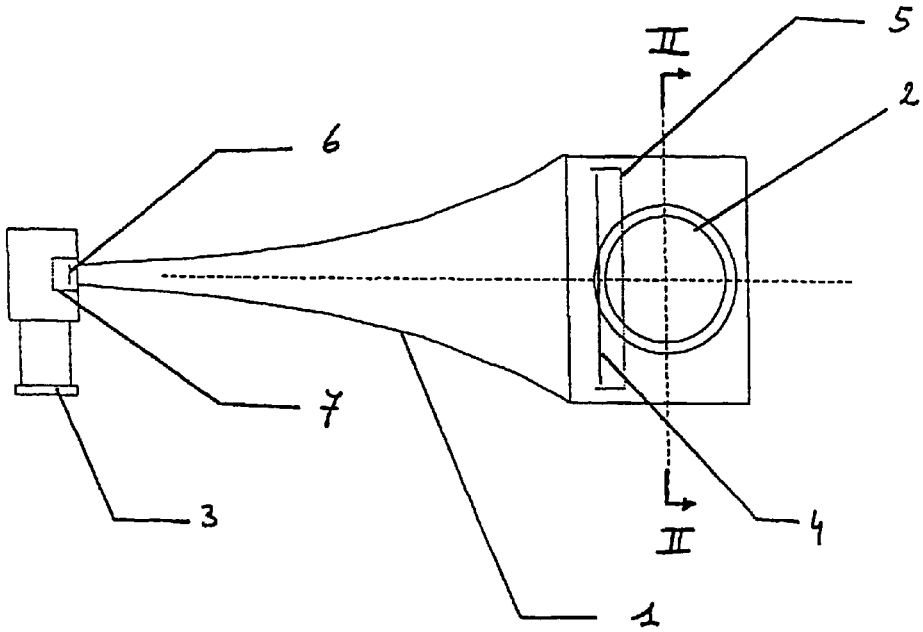
FIG. 1 is a schematic upright projection of a first embodiment of a vacuum pump according to the invention.
Figure 2:
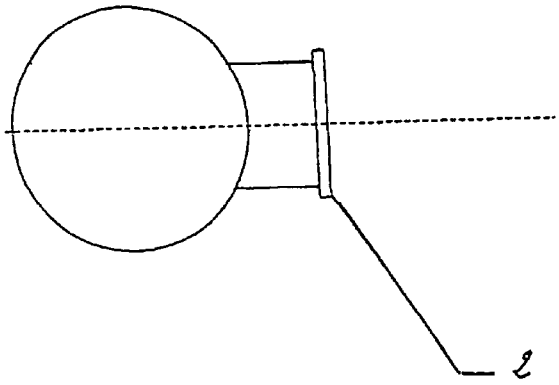
FIG. 2 represents a section according to line II—II in FIG. 1.

FIGS. 1 and 2, which concern a first embodiment of the vacuum pump according to the invention, schematically represent a pump with one stage or possibly a specific stage of a pump with several stages.

This stage or this pump comprises a chamber or hollow body 1 having, on one of its sides, an intake opening 2 and, on the opposite side, an outlet opening 3.

The displacement means, forming the drive unit of the pump, are formed in this particular case of a membrane or vibratory plate 4 supported by an armature 5 in the chamber 1, near the intake opening 2. This plate or membrane 4 makes it possible to generate sound waves and thus successive compression and underpressure zones in the chamber 1.

In this particular embodiment, the hollow body or the chamber 1 as an inner shape in the shape of a pavilion, whose section decreases in a logarithmic manner as of the intake opening 2 to the outlet opening 3. The closing means of the outlet opening 3 consist of a valve 6, supported by an armature 7, which, when the pressure P on the narrow side of the pavilion 1, i.e. near the outlet opening 3, is higher than the base pressure $P_0$, opens, thus allowing part of the gas to escape via said outlet opening 3, while an equivalent amount of gas enters via the intake opening 2.

When the pressure P drops under the base pressure $P_0$, on the side of the outlet opening 3 of the pavilion 1, the valve 6 is closed in order to prevent the gas, which has initially flown towards the high-pressure side, i.e. the side of the outlet opening, from being driven back from the low-pressure side of the chamber 1 near the intake opening 2.

The driving effect of the pumping thus resides in the displacement at sonic speed of a blast wave from the intake opening 2 towards the outlet opening 3 of the pavilion 1.

Figure 3:
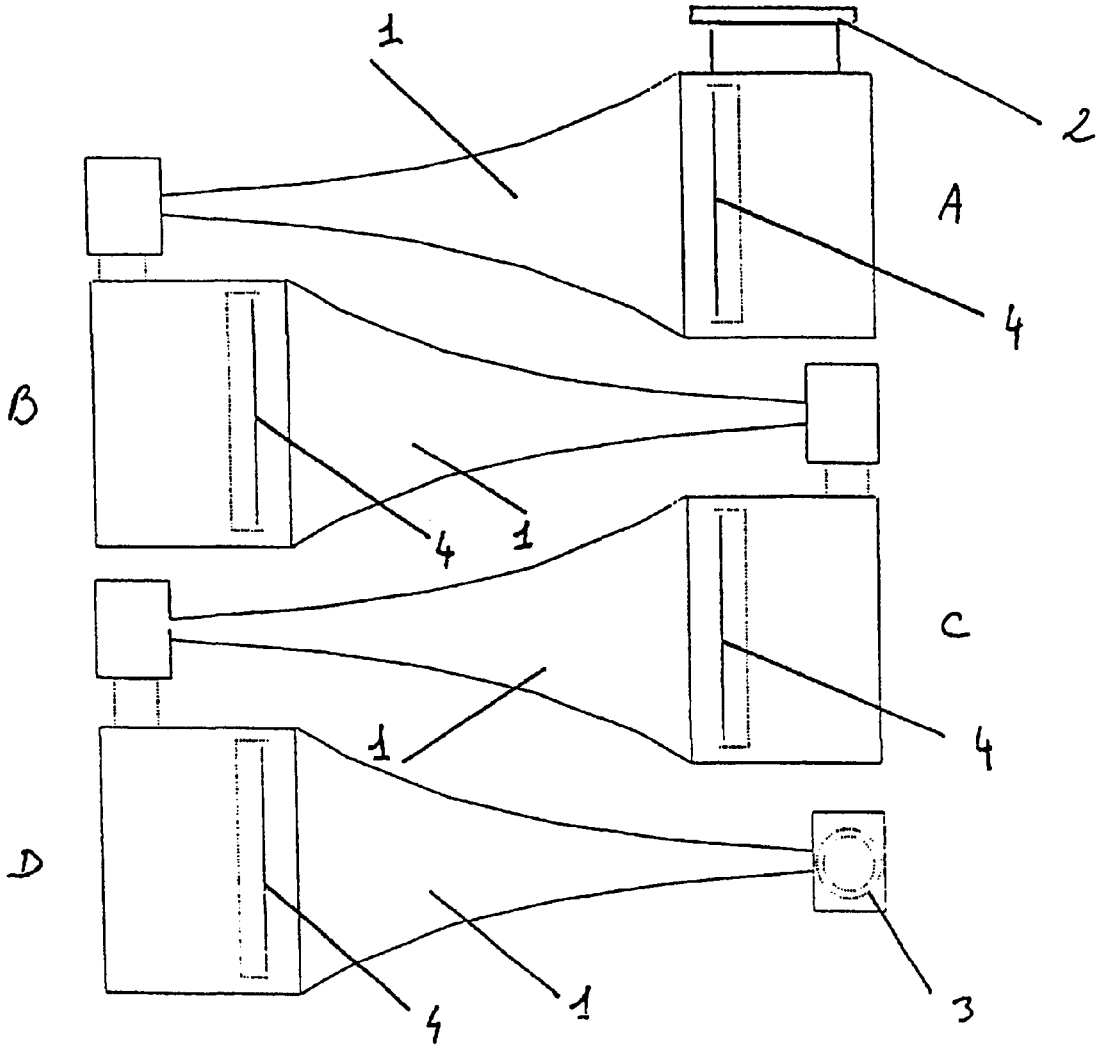
FIG. 3 is a schematic upright projection of several vacuum pumps according to the first embodiment of the invention mounted in line.

FIG. 3 schematically represents a vacuum pump according to the invention with four successive stages A, B, C and D. These stages are identical and each correspond to the embodiment of the pump as represented in FIGS. 1 and 2.

In this four-stage pump, the chambers 1 of each stage are mounted in line, whereby the outlet opening of a particular stage is coupled to the intake opening of the next stage, and so on.

Figure 4:
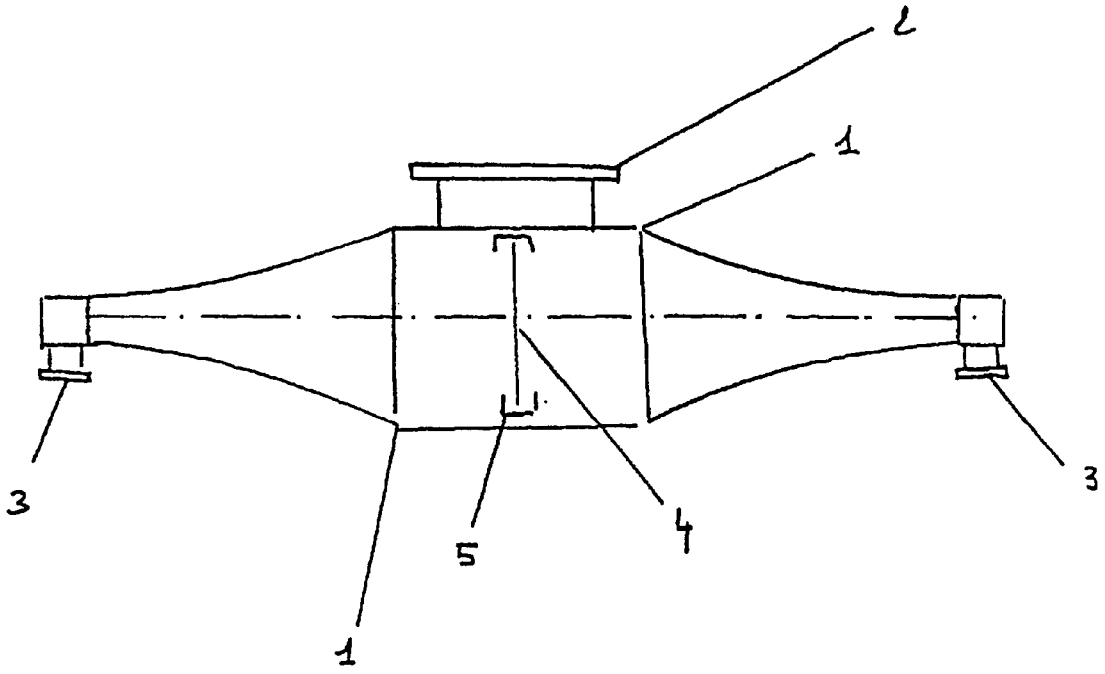
FIG. 4 is an upright projection of a second embodiment according to the invention.

FIG. 4 concerns a second particular embodiment of the vacuum pump according to the invention.

In this embodiment, a chamber 1 extends on either side of the vibrating element 4.

A single intake opening 2 is provided near this vibrating element 4, such that the gas can penetrate in both parts of the chamber 1 on either side of said element, and can spread towards the outlet opening 3 of each.

This configuration has for an advantage that the pumping speed can be doubled in relation to the vibrating element with the same consumption of energy.

As in the embodiment represented in FIG. 3, the vacuum pumps which correspond to this second embodiment can be connected in line so as to form a pump with several stages. To this end, one only has to connect the outlet openings 3 of any of the pumps to the intake opening 2 of a pump mounted downstream in relation to these outlet openings 3.

Advantageously, a stationary sound wave is generated in the chamber 1 of the pump according to the invention, whose aim is to amplify the pressure variations. To this end, the distance separating the intake opening 2 from the outlet opening 3 of the chamber 1, and in particular the distance separating the outlet valve 6 from the excitation membrane 4, and the vibration frequencies of the latter are such that they can generate said stationary sound wave in the gas contained in the chamber 1. The excitation frequency of the vibrating element 4 must thus be adapted to the sonic speed in the gas to be pumped. This frequency depends among others on the average molecular mass and the temperature of the gas.

Thus, at a constant temperature and for a specific distance between these two openings 2 and 3, when passing from a gas with a low molecular mass to a gas with a higher molecular mass, the sonic speed in the gas diminishes and the excitation frequency has to be diminished accordingly in order to obtain resonance, i.e. the formation of a stationary sound wave.

For example, between argon having an atomic mass 40 and hydrogen having a molecular mass 2, the excitation frequency will have to be 4.5 times higher for hydrogen than for argon. The excitation frequency is generally inversely proportional to the square root of the average molecular or atomic mass of the gas to be pumped.

A pump with a chamber 1 in the shape of a pavilion makes it possible to obtain compression ratios with a minimum number of stages. In the hypothesis of the displacement of a sound wave from the intake 2 to the outlet 3 of the pavilion 1, the volume in which an overpressure zone is trapped, over a length which is equivalent to half the wave length of the sound wave with a constant frequency, is progressively reduced from the intake opening 2 to the outlet opening 3 of the stage in question of the pump. As a result, the positive pressure variation in question will rise as a sound wave is displaced from the intake opening 2 to the outlet opening 3 of the pump, proportionately to the ratio of the occupied volumes on the intake and on the outlet of the latter.

Advantageously, the vibration amplitude of the vibrating element 4 is at least equal to two times the average free path between the elastic collisions of the gas particles in the chamber 1, at said vibrating element.

The minimum dimensions of the passage section-of the gas are preferably at least equal to two times the average free path between the elastic collisions of gas particles at said passage.

The pump according to the invention, namely as illustrated in the accompanying figures, which makes it possible to obtain high pumping speeds, operates at excitation frequencies of the vibrating element 4 which are generally lower than 20,000 Hz and preferably between 20 Hz and 5,000 Hz.

The pavilion 1 of the vacuum pump according to the invention can have very different shapes and dimensions.

Thus, without this list being limitative as far as the curve of the longitudinal section of these pavilions is concerned, the obtained intersecting line can have an exponential, straight or even a hyperbolic shape. Moreover, this line can possibly be formed of successive portions of different configurations, for example a part which varies exponentially followed by a straight part.

Further, the pump and in particular the chamber 1 of the latter must not necessarily be designed according to a straight axis between the intake opening 3 and the outlet opening 4. It can be curved, for example so as to assume the shape of a hunting horn.

Further, the pavilion or pavilions of the vacuum pump according to the invention can have a section, perpendicular to the direction in which the gases flow, which is circular-shaped, elliptic or polygonal, in particular rectangular.

What follows is a practical example of an embodiment of a vacuum pump according to the invention, comprising four stages, as represented in FIG. 3.

It is a pump functioning with what is called an exponential pavilion, identical for each of the four stages, equipped with a discharge valve 6 and an excitation membrane 4 respectively, made of PVDF, in the middle of which is fixed an electromagnet, not represented here, and kept in place by the armature 5 while being directed towards the discharge valve 6. The diameter of this excitation membrane is 419 mm, which makes it possible to obtain an opening area which is useful for the passage of the gas, comprised between the body of the pump 1 and its periphery, which is equivalent to that of the intake opening 2, having a nominal diameter of 250 mm. In this way, the surface of the excitation membrane 4 represents more than 73% of the maximum opening surface of the pavilion. The membrane is made to vibrate thanks to a central excitation, realised by means of the above-mentioned electromagnet, thus forming an electrodynamic device which is solidary with the armature 5, whereby its frequency is directly fixed by the vibration frequency of the electrodynamic device.

The inner diameter of the pavilion amounts to 40 mm on the narrow side, i.e. on the outlet opening 3, and to 488 mm on the opposite widened side, i.e. on the intake opening 2 of each stage over a total length of 1 meter as of the excitation membrane 4 up to the outlet valve 6 of each stage.

When the membrane 4 is excited at each stage at 300 Hz, a maximum compression ratio of 2.54 is obtained per stage, which results in a total maximum compression ratio for the four stages of the pump of 41.6.

Still under the same conditions, the pumping speed of the pump amounts to 7,310 $m^3$ per hour.

Thus, this is a pump which is perfectly fit to be connected between a primary pump and a molecular pump, thus forming part of what is called a "high vacuum" pump group.

Thus, when a pressure of 1 mbar is maintained on the intake of the first stage of this pump, a pressure of 12 mbar is observed on the outlet of the last stage if the latter is connected to a primary pump, which makes it possible to obtain a pumping speed of 600 $m^3$/hour. The practical compression ratio in this case is 12.

Under these conditions, it is possible to generate sound waves in the gas behaving like a liquid, and which consequently differs from a molecular flow.

In a liquid flow, there is interaction between the gas molecules, whereas, in a molecular flow, the molecules behave like particles which are considerably independent from one another.

On the basis of the above-mentioned data, in the case where the gas consists of air, a craftsman can make the following calculations, to obtain the above-mentioned results:

$$\frac{\Delta P}{P} = -\gamma \cdot a \cdot e^{\frac{\mu x}{2}\left[k \sin(wt-kx) - \frac{\mu}{2}\cos(\omega t-kx)\right]}$$

Immediate Pressure Variation in an Exponential Pavilion $\Delta P$=local pressure variation in the pavilion $P_o$=base pressure at the intake of the pavilion a=vibration amplitude of the membrane x=distance from the intake of the pavilion, measured as of the excitation membrane 4 v=vibration frequency of the excitation membrane t=time
$\omega=2\pi v$
y=1,4 (air)
$\mu=5m^{-1}$ $$k=\sqrt{\frac{\omega^2}{c^2}-\frac{\mu^2}{4}}$$

whereby c represents the sonic speed in the gas:

$$c=\sqrt{\frac{\gamma k_B T}{M}}$$

whereby
$k_B=1.3807.\ 10^{-23}\ JK^{-1}$ represents the Boltzmann constant
T=temperature in degrees Kelvin
M=average molecular mass of a gas particle The pavilion is defined by its length L=1 m (distance between the excitation membrane on the intake of the pavilion and the outlet of the pavilion) and by the surface S of its cross section at a distance x from the membrane (intake section), whereby $S=S_o e^{\mu(L-x)}$
$S_o$=surface of the section on the outlet of the pavilion In the case of the above-mentioned example was assumed a vibration frequency of the excitation membrane v=300 Hz with a vibration amplitude a=0.04 m. The example concerns a pump operating in air at a T=300K. Under these conditions, the sonic speed c=352 m/s.

Cut-off Frequency of the Pavilion ($V_c$)

$$V_c=\frac{\mu.c}{4\pi}=\frac{5.352}{4.\pi}=140\ \text{Hz}$$

Resonance Frequency in the Pavilion ($V_c$)

$$\frac{C}{4L}=88\ \text{Hz}$$

corresponds to the fundamental vibration mode of the gas. This mode is not allowed, as this frequency is inferior to the cut-off frequency of the pavilion, i.e. 140 Hz. Hence, the lowest useful resonance frequency amounts to 262 Hz.

The above-mentioned calculations are only valid when the gas behaves according to a liquid flow and not according to a molecular flow in relation to the shape and dimensions of the pump, i.e. the average distance between two elastic collisions of for example air molecules ($N_2$ or $O_2$) must be at least two times and preferably a hundred times smaller than the smallest geometric dimension which is characteristic (d) for said pump, required for its operation, including the vibration amplitude (a) of the excitation membrane. This may concern e.g. the diameter of the intake opening, the local inner diameter of the pavilion, etc.

Characterisation of the Type of Gas Flow by the Knudsen Number Kn

Kn (see for example: Foundations of Vacuum Science and Technology ed., by J. M. Lafferty, John Wiley & Sons, 1998-ISBN N° O-471-17593-5).

$$Kn=\frac{\lambda}{d}$$

d=geometric dimension (e.g. diameter of a duct or minimum dimension of a passage for the gas particles).

λ=average free path between two elastic collisions of gas particles.

| | | For the air (P in mbar, d in mm) |
|---|---|---|
| Molecular flow | $Kn=\frac{\lambda}{d}>0.5$ | P.d < 0.133 |
| Transition flow | 0.5 > Kn > 0.01 | 0.133 < P.d < 6.6 |
| Strictly liquid or continuous flow | Kn < 0.01 | P.d > 6.6 |

Figure 5:
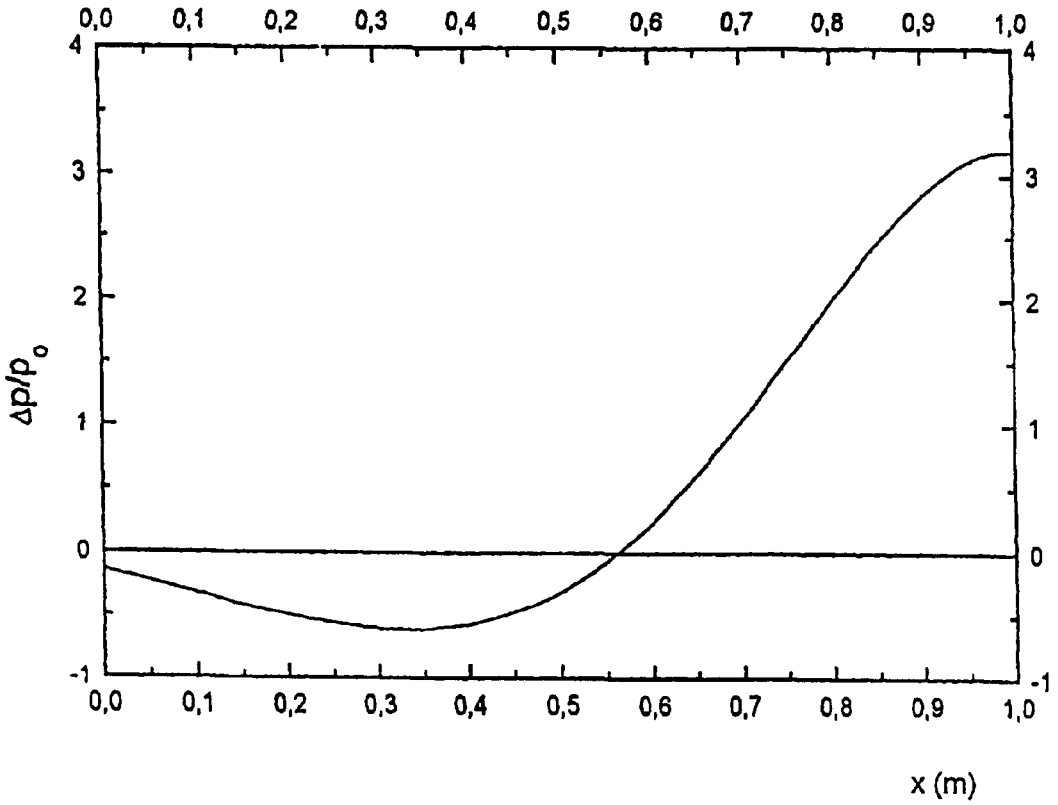
FIG. 5 represents the evolution of the relative pressure variation, $\Delta p/p_o$, in the pavilion according to FIG. 1 as a function of the distance as of the vibrating element.

On the basis of these calculations, it was possible to make the graph according to FIG. 5 which represents the relative local pressure variation $\Delta p/p_o$ as a function of the position in the pavilion for the following parameter values: $\mu=5\ m^{-1}$, L=1 m, v=300 Hz. The geometric dimensions of the pump are such that Kn is always strictly inferior to 0.5. Hence, the molecular flow is not realised in any part of the pump. Thus, the same applies to the vibration amplitude a of the excitation membrane 4, since for a=40 mm and at the lowest pressure in the pump, i.e. P=0.01 mbar, a value aP=0.4>0.133 mbar.mm is obtained. This value indicates that the perturbation flow of the gas as a result of the displacement of the membrane is not molecular.

According to the invention, the vacuum pump is preferably such that it has to be able at least to realise a total compression ratio of over 2 per stage when the pressure is lower than 1000 mbar.

A high compression ratio, in particular of over 2, indicates that the vibration amplitude of the excitation membrane is much higher than when the compression ratio is close to the unit.

This is of major importance in order to allow the pump to operate at a pressure which is inferior to the atmospheric pressure and in particular below 10 mbar.

Indeed, in order to enable the pump according to the invention to operate, it is necessary that the gas behaves like a liquid.

Therefor, the average free path between two elastic collisions of gas particles has to be significantly inferior to the geometric dimension which is characteristic for the entire passage section of the gas in the pump, i.e. the chamber of the latter in which sound waves are generated, in particular the hydraulic diameter of the passage section of the gas situated between the excitation membrane 4 and the intake of the pavilion of said chamber 1. This free path also has to be significantly inferior to the vibration amplitude of the excitation membrane.

This condition is naturally fulfilled for pressures which are superior to or equal to the atmospheric pressure. However, this is not the case for relatively low pressures, e.g. which are lower than 1000 mbar, whereby certain geometric precautions and more generally physical precautions have to be taken, among others regarding the vibration amplitude of the membrane, in order to avoid an outgoing liquid flow and especially a molecular flow on the intake in certain places of the hollow body of the pump. This is particularly important in the vicinity of the excitation membrane.

More concretely, the conductance has to be as high as possible, especially at the intake of the pump. For this reason, the section of the intake opening near the excitation membrane must be as large as possible and may not be obstructed by a valve. A liquid flow should be immediately obtained at the membrane, and such up to the outlet opening.

This is particularly difficult near the intake opening which is situated just above the membrane.

Thus, it has become clear, according to the invention, that the compression ratios considered per stage and, naturally, for the whole of the stages connected in line, are much higher than those required for thermo-acoustic applications, such as described for example in U.S. Pat. No. 5,295,791, which was already mentioned above in the introduction, in the description. Thus, in the pressure range situated between 0.1 mbar and 10 mbar is required a maximum compression ratio (with a zero yield) of at least ten in order to allow the vacuum pump according to the invention to advantageously replace for example a "Root" compressor.

Advantageously, such a compression ratio is possible by applying a high vibration amplitude to the excitation membrane, of several millimetres to a few centimetres, e.g. 5 mm to 10 cm.

In particular, the relation of the length of the average free path $\lambda$ between two elastic collisions and the vibration amplitude a should be inferior to 0.5 and preferably inferior to 1%.

The same applies to the relation between $\lambda$ and the hydraulic diameter DH (equal to 4 times the section surface of the gas passage in the plan in question, divided by the perimeter of said section), which has to be strictly inferior to 0.5 and preferably inferior to 1% in the pressure range in which the pump is used. This relation is known as the Knudsen number.

The use of a pavilion makes it possible, by reducing the passage surface of the gas from the intake opening to the outlet opening of the pump, to increase the compression ratio of each stage of the pump, all the more as this variation in section is important. However, in this case, the vibration frequency of the excitation membrane should be higher than the cut-off frequency as of and under which it becomes impossible to transmit a wave in the pavilion.

The pump works in resonance mode at the lowest harmonic, which is strictly superior to the cut-off frequency of the pavilion, such that the compression ratio is increased by reducing the forces of inertia which counteract the displacement of the membrane. For the same reason, the latter is made of a material having a low density and a high mechanical resistance, such as for example a polymer film, reinforced with carbon fibres. Thus, in the practical example given above, the fundamental resonance mode of 87.5 Hz cannot be used as it is inferior to the cut-off frequency of the pavilion which, in this particular case, amounts to 140 Hz. However, the first harmonic of each stage of the pump, being 262.5 Hz, can be advantageously put to use to increase the compression ratio by forming a stationary sound wave.

It is also important, as already mentioned above, that the intake and outlet connections are as short as possible and that their sections are as large as possible, such that their conductance is at least 10 times higher than the pumping speed of the pump.

It should be noted that, in the case where the pump has a rectangular cross section instead of a circular one and represents an identical variation in the section surface according to its axis, while the length between the outlet opening 3 and the intake opening 2 is maintained, as well as the surface of the excitation membrane 4, both types of pumps will have the same capacity. However, in the case where the excitation membrane 4 is rectangular, the latter can advantageously be made of a piezoelectric sandwich film, supported by the armature 5. In this case, the membrane forms a sandwich structure composed of an assembly of two PVDF-films, provided with a metal coating on either face before being assembled and fastened to one another by means of an electrically conductive adhesive. The thus formed assembly can be made to vibrate by subjecting the central conductive coating of the piezoelectric sandwich structure to an alternating potential variation in relation to the potential of the metal coatings of the outer surfaces of the structure. Moreover, said potential is preferably that of the mass of the system. In order to make the system work properly, the two piezoelectric films should be provided such that, when one film dilates, the other one shrinks, and inversely, thus forcing the sandwich structure as a whole, supported by the armature 5, to form a curve and to vibrate in a direction perpendicular to its transversal plane at a frequency which is equal to the electric excitation frequency.

From what precedes results that the vacuum pump according to the invention does not contain any rotating elements and, consequently, does not require any of the mechanical precautions which need to be taken when mounting a camp pump. Thus, thanks to its design, the pump according to the invention does not represent any risk of being damaged due to any contact with moving elements, nor of the gas being driven from the outlet towards the intake of the pump due to adsorption by mobile elements.

Moreover, the vibrating element, forming the driving unit of the vacuum pump according to the invention, may represent very different designs and constructions. Generally, any light mobile element which can be made to vibrate by any suitable device whatsoever, for example an electromechanical, electromagnetic, piezoelectric or magnetostrictive device, is suitable as a vibrating element.

Another advantage of the pump according to the invention in relation to the known volumetric pumps is that it does not require a tight, mobile passage, liable to possible leaks and energy losses due to friction, such that it consumes significantly less energy compared to the known volumetric pumps. Finally, as opposed to for example pumps operating by means of a volumetric drive, it does not require a by-pass.

Naturally, the invention is not restricted to the different embodiments described above and represented in the accompanying drawings; on the contrary, a number of other variants are possible, in particular as far as the construction and shape of the chamber 1, the valve 6 and the displacement means are concerned, in particular the vibrating element, while still remaining within the scope of the invention.

Thus, in certain cases, the chamber may have a constant section between its intake opening and its outlet opening.

What is claimed is:

1. Vacuum pump, with an acoustic compressor comprising a chamber (1) having, on one of its sides, an intake opening (2) for the gas to be pumped and, on the opposite side, an outlet opening (3) for said gas, at least one vibrating element (4) provided near the intake opening (2) for moving the gas from said intake opening (2) towards the outlet opening (3), characterised in that means are provided to subject the vibrating element (4) to a vibration having an amplitude which is at least two times higher than the average free path between the elastic collisions of the gas particles in the chamber (1), whereby said average free path corresponds to the local pressure measured near the vibrating element for generating, at a prevailing pressure in the chamber (1) between $10^{-2}$ and 1000 mbar, sound waves forming successive compression and depression zones in said gas between the intake opening (2) and the outlet opening (3).

2. Pump according to claim 1, characterised in that the above-mentioned chamber (1) has a cross section which decreases in relation to the direction of movement of the gas from the intake opening (2) towards the outlet opening (3).

3. Pump according to claim 2, characterised in that the above-mentioned chamber (1) has the shape of a bell whose section decreases as of the intake opening (2) of the gas up to the outlet opening (3) of the gas.

4. Pump according to any of claims 1 to 3, characterised in that said vibrating element (4) comprises a membrane (4) extending in a transversal plane in relation to the direction in which the gas is displaced between the intake openings (2) and the outlet openings (3) of the above-mentioned chamber (1).

5. Pump according to any of claims 1 to 3, characterised in that said vibrating element (4) comprises an electromechanical, or electromagnetic vibration mechanism with at least one of a piezoelectric and magnetostrictive vibrating capacity.

6. Pump according to any of claims 1 to 3, characterised in that it contains at least one vibrating element (4) having a frequency of less than 20,000 Hz.

7. Pump according to any of claims 1 to 3, characterised in that the distance separating the intake openings (2) and the outlet openings (3) of the chamber (1) and the vibration frequency of said vibrating element (4) are such that it is possible to generate stationary waves in the gas contained in the chamber (1).

8. Pump according to any of claims 1 to 3, characterised in that closing means are provided which comprise a discharge valve (6) co-operating with control means to open the valve (6) when the pressure prevailing in the chamber (1) is higher than a base pressure upstream the intake opening (2), and to close this valve (6) when said pressure is lower than or equal to said base pressure, whereby this valve (6) is opened and closed at a frequency which significantly corresponds to the frequency of, or which is, in an integer ratio, less than the frequency of the vibrating element (4).

9. Pump according to any of claims 1 to 3, characterised in that a chamber (1) of the above-mentioned type extends on either side of the vibrating element, whereby at least one intake opening (2) is provided near this element (4) such that the gas can penetrate in both parts of said chamber and can spread towards the outlet opening of each.

10. Pump according to any of claims 1 to 3, characterised in that the outlet opening (3) of one chamber is connected to the intake opening (2) of another chamber provided in line with the first one.

11. Pump according to any of claims 1 to 3, characterised in that the above-mentioned intake opening (2) opens in the above-mentioned chamber near the vibrating element (4) and on the side of the latter directed towards the outlet opening (3) of the chamber (1).

12. Pump according to any of claims 1 to 3, further comprising closing means (6) for the outlet opening (3) synchronously co-operating with the vibrating element (4), such that the outlet opening (3) is cleared when the gas pressure in the proximity of said opening (3) is equal to or higher than that in the proximity of the outlet opening.

13. Pump according to any of claims 1 to 3, characterised in that the distance between the intake opening (2) and the outlet opening (3) is such that it is possible to generate, by means of the vibrating element (4), a stationary wave at the lowest resonance frequency in the gas situated immediately above the cut-off frequency in the chamber (1).

14. Pump according to claim 1, characterized in that it contains at least one vibrating element (4) having a frequency comprised between 20 and 5,000 Hz.

15. Pump according to claim 1, characterised in that said means are provided to subject the vibrating element (4) to a vibration having an amplitude which is at least a hundred times higher than said average free path between the elastic collisions of the gas particles in the chamber (1).

16. Pump according to claim 1, characterised in that said average free path corresponds to the local pressure measured near the vibrating element for generating, at a prevailing pressure in the chamber (1) between 0.01 and 10 mbar, sound waves forming successive compression and depression zones in said gas between the intake opening (2) and the outlet opening (3).

17. Vacuum pump with an acoustic compressor comprising a chamber (1) having, on one of its sides, an intake opening (2) for the gas to be pumped and, on the opposite side, an outlet opening (3) for said gas, at least one vibrating element (4) provided near the intake opening (2) for moving the gas move from the intake opening (2) towards the outlet opening (3), means being provided to subject the vibrating element (4) to a vibration having an amplitude which is at least two times higher than the average free path between the elastic collisions of the gas particles in the chamber (1), whereby said free path corresponds to the local pressure measured near the vibrating element (4) for generating, at a prevailing pressure in the chamber (1) between 0.01 and 10 mbar, sound waves forming successive compression and depression zones in said gas between the intake opening (2) and the outlet opening (3), characterized in that closing means (6) are provided at the outlet opening (3) which synchronously co-operate with the vibrating element (4), such that the outlet opening (3) is cleared when the gas pressure in the proximity of said opening (3) is higher than the average pressure, named base pressure, prevailing at the inlet opening (2).

* * * * *